US007429167B2

(12) United States Patent
Bonear et al.

(10) Patent No.: US 7,429,167 B2
(45) Date of Patent: Sep. 30, 2008

(54) SCROLL MACHINE HAVING A DISCHARGE VALVE ASSEMBLY

(75) Inventors: Ron Bonear, Centerville, OH (US); Michael Perevozchikov, Tipp City, OH (US); Kirill Ignatiev, Sidney, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 147 days.

(21) Appl. No.: 11/108,661

(22) Filed: Apr. 18, 2005

(65) Prior Publication Data

US 2006/0233657 A1 Oct. 19, 2006

(51) Int. Cl.
*F04C 18/00* (2006.01)
*F16K 21/10* (2006.01)
*F16K 21/12* (2006.01)

(52) U.S. Cl. ..... 418/55.1; 418/270; 137/514.3; 137/514.5; 92/85 B

(58) Field of Classification Search ..... 418/55.1, 418/270; 92/85 B; 137/514.3, 514, 514.5, 137/514.7
See application file for complete search history.

(56) References Cited

U.S. PATENT DOCUMENTS 1,322,938 A * 11/1919 Parker ..... 137/514.7
2,929,401 A * 3/1960 Cowan ..... 137/516.29
3,735,777 A * 5/1973 Katzer et al. ..... 137/514.5
4,717,314 A * 1/1988 Sato et al. ..... 417/310
4,729,402 A * 3/1988 Blass et al. ..... 137/514.5
4,747,756 A * 5/1988 Sato et al. ..... 417/307
4,877,382 A 10/1989 Caillat et al.
4,904,165 A * 2/1990 Fraser et al. ..... 417/312
5,102,316 A 4/1992 Caillat et al.
5,156,539 A 10/1992 Anderson et al.
5,320,506 A 6/1994 Fogt
5,346,373 A * 9/1994 Riffe ..... 417/415
5,494,422 A * 2/1996 Ukai et al. ..... 418/55.1
5,683,236 A * 11/1997 Harrison et al. ..... 418/55.1
5,800,141 A * 9/1998 Ceylan et al. ..... 418/55.1
5,964,248 A * 10/1999 Enarson et al. ..... 137/625.39
6,056,523 A * 5/2000 Won et al. ..... 418/55.1
6,132,191 A * 10/2000 Hugenroth et al. ..... 418/55.1
6,139,291 A 10/2000 Perevozchikov
6,179,589 B1 * 1/2001 Bass et al. ..... 418/55.1
6,213,731 B1 * 4/2001 Doepker et al. ..... 417/310
6,227,830 B1 5/2001 Fields et al.
6,312,232 B1 * 11/2001 Mori et al. ..... 417/297
6,537,043 B1 3/2003 Chen
6,634,375 B2 * 10/2003 Olivas et al. ..... 137/512.3
6,739,847 B1 * 5/2004 Tarng et al. ..... 418/55.1
6,899,113 B2 * 5/2005 Parrish et al. ..... 137/514.3
7,108,494 B2 * 9/2006 Nam ..... 418/55.1
2002/0012595 A1 * 1/2002 Kouno et al. ..... 417/559

* cited by examiner

FOREIGN PATENT DOCUMENTS

EP 1085211 A2 * 3/2001
JP 1-130082 5/1989
JP 2003239879 A * 8/2003

*Primary Examiner*—Thomas Denion
*Assistant Examiner*—Mary A Davis
(74) *Attorney, Agent, or Firm*—Harness, Dickey & Pierce, P.L.C.

(57) ABSTRACT

A discharge valve assembly is provided for preventing reverse rotation of a scroll compressor. The discharge valve assembly includes a cup-shaped valve member slidably engaged with a central post of a retainer member. The cup-shaped valve member includes notches in communication between the central post of the retainer and the sidewalls of the cup-shaped valve member.

27 Claims, 9 Drawing Sheets

FIG 2
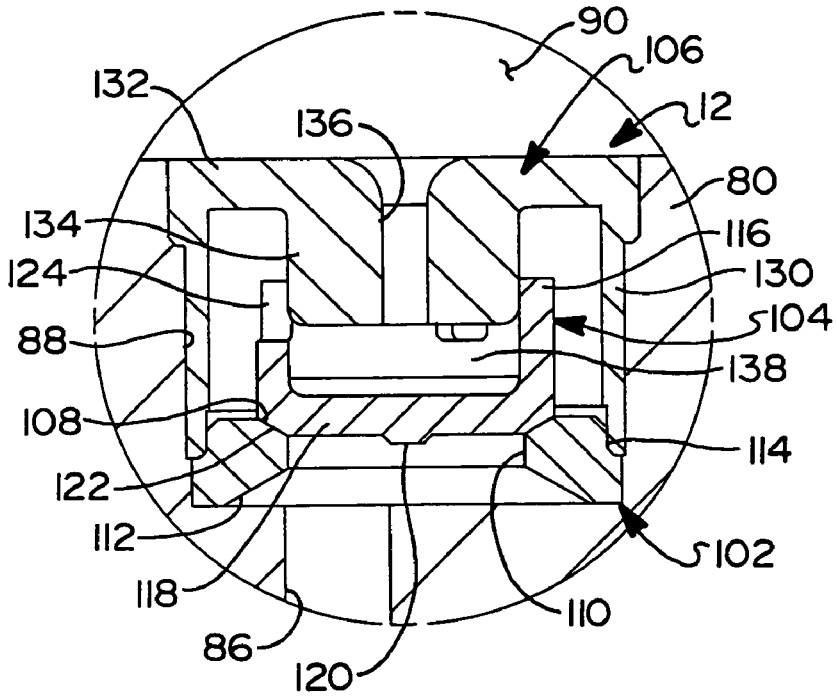
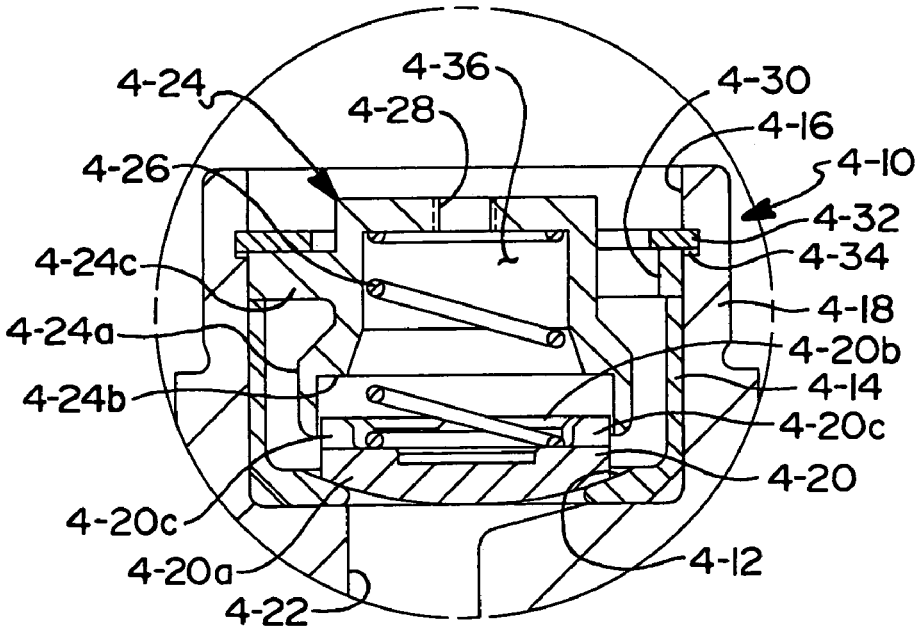
FIG 4

FIG 5B
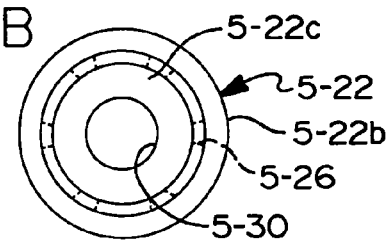
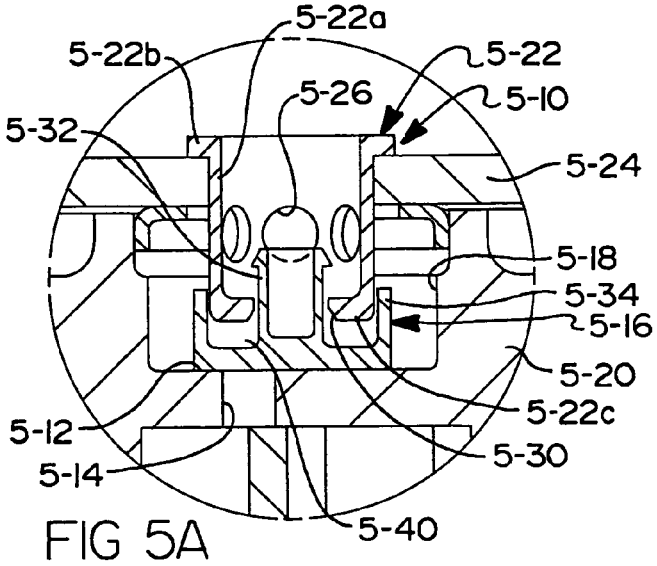
FIG 5A
FIG 6B
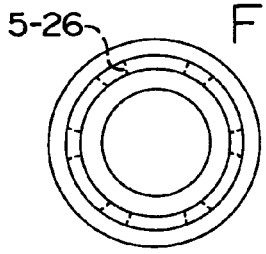
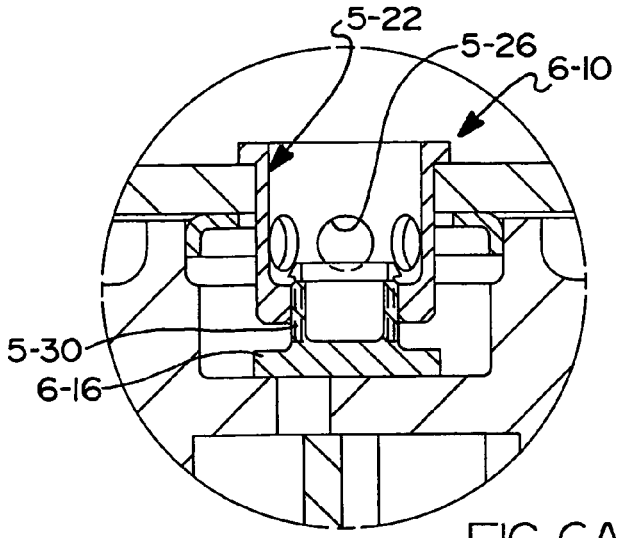
FIG 6A

FIG 7B
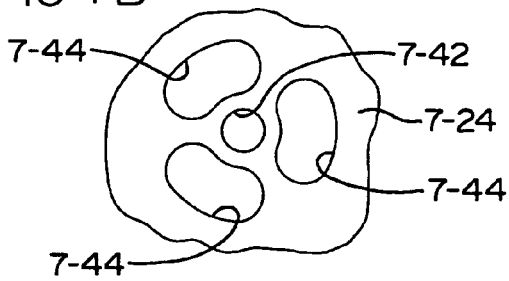
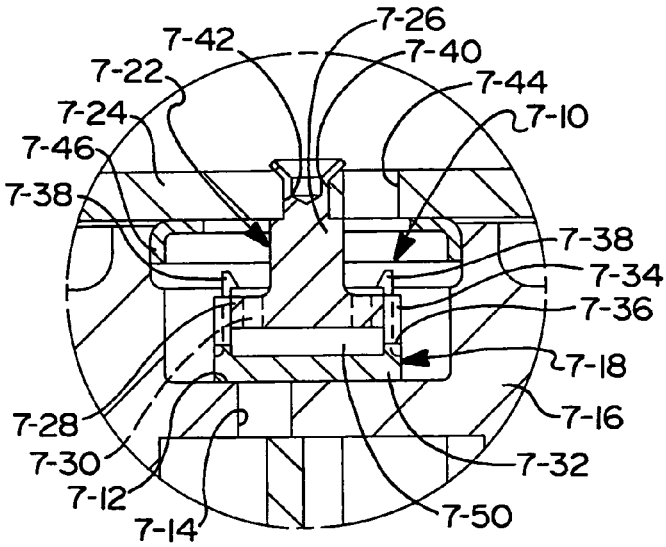
FIG 7A
FIG 8B
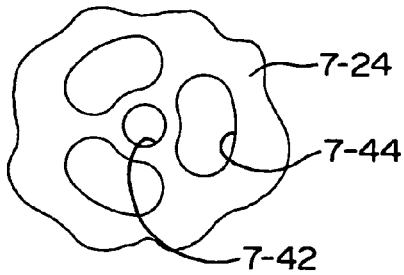
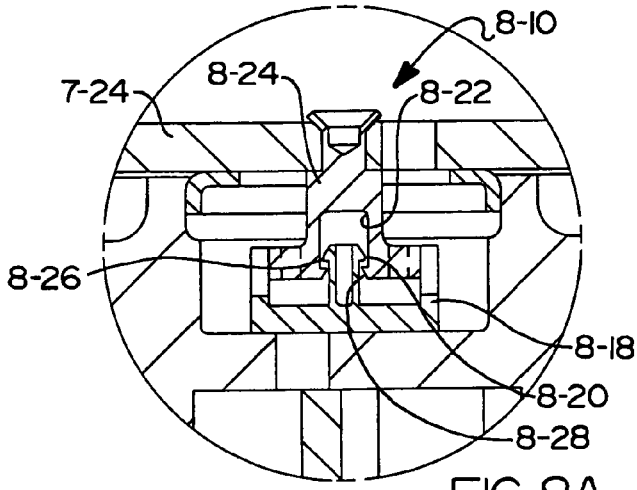
FIG 8A

FIG 9
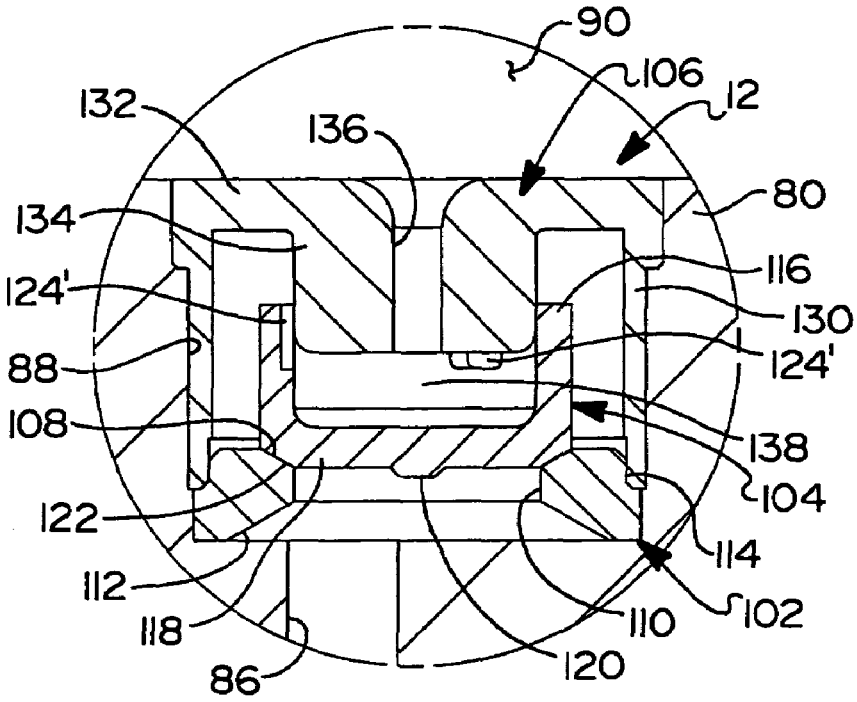
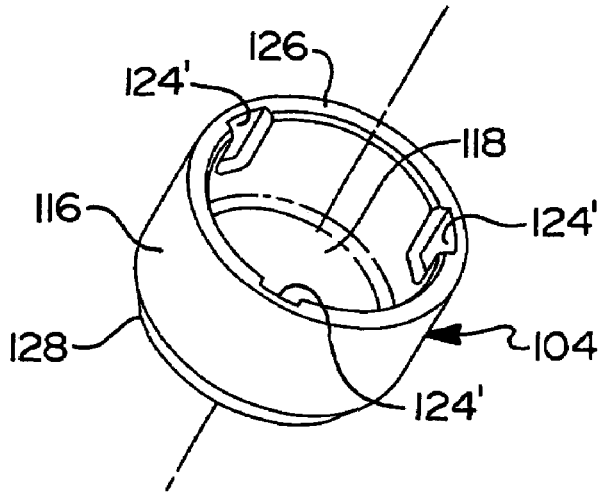
FIG 10

FIG 11
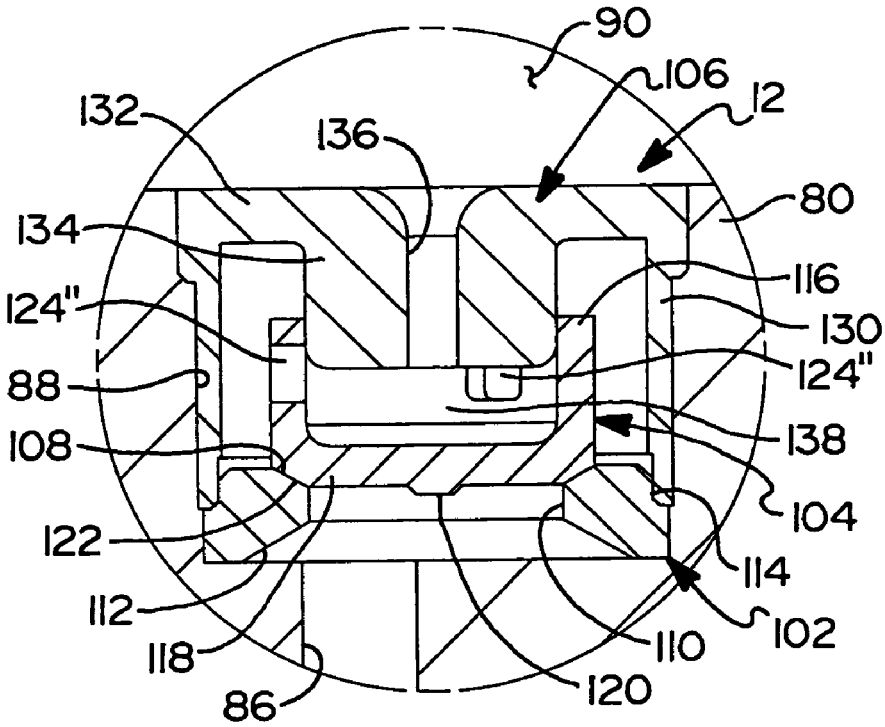
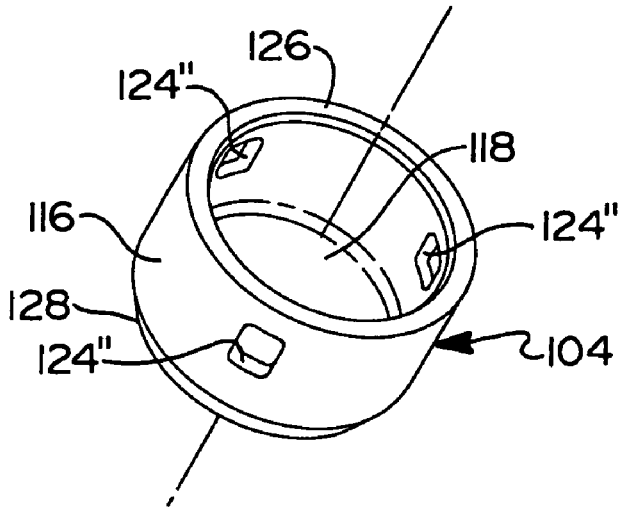
FIG 12

FIG 13
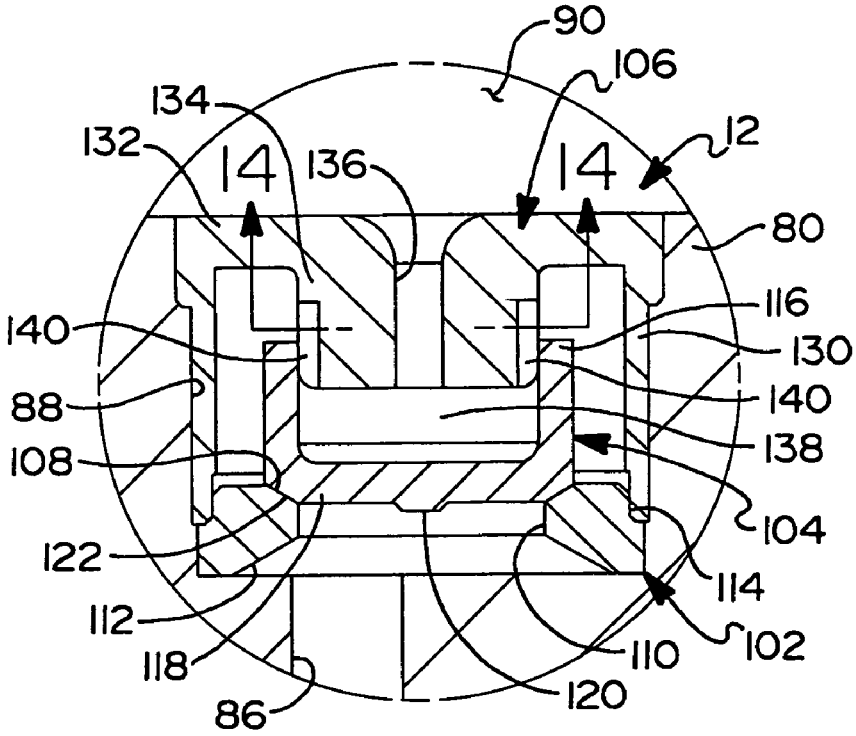
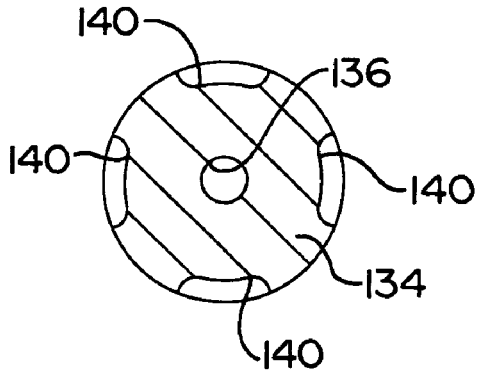
FIG 14

FIG 15A
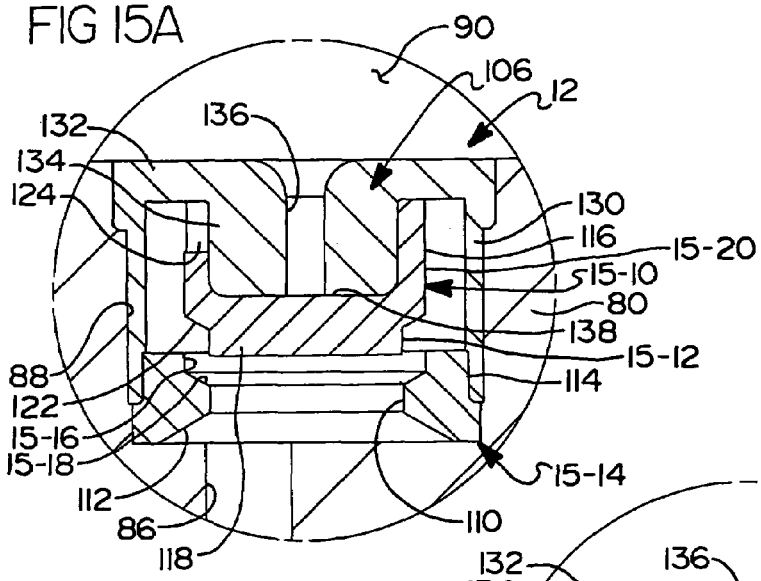
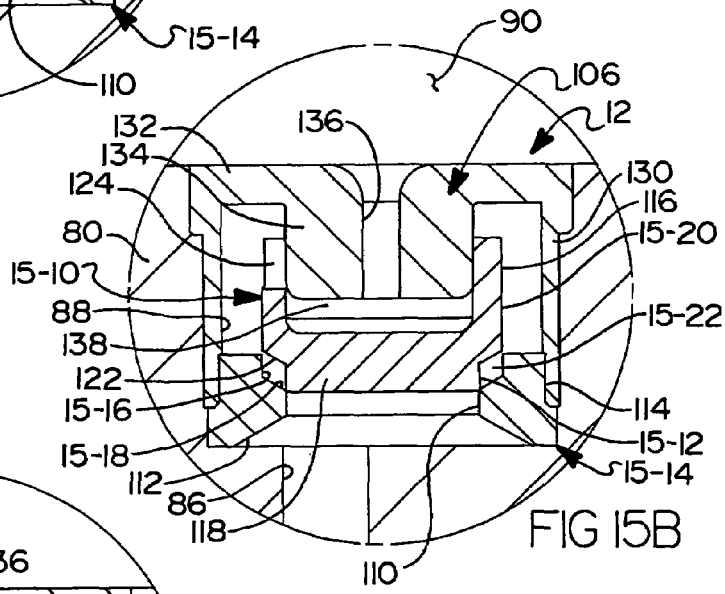
FIG 15B
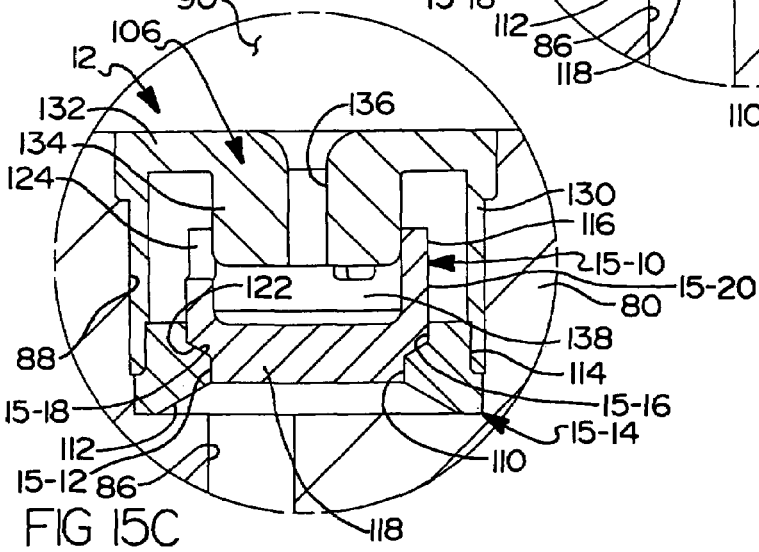
FIG 15C

SCROLL MACHINE HAVING A DISCHARGE VALVE ASSEMBLY

FIELD OF THE INVENTION

The present invention relates to scroll compressors, and more particularly, to discharge valves for preventing reverse rotation of a scroll compressor at shutdown.

BACKGROUND AND SUMMARY OF THE INVENTION

Scroll compressors have become widely utilized in many refrigerant compression applications. Scroll compressors are relatively efficient, and are being utilized in more and more applications. In a typical scroll compressor, the compression chambers are defined by two generally spiral wraps. The spiral wraps are formed on individual scroll members, and extend from a base plate. The spiral wraps interfit to define compression chambers. One of the spiral wraps is driven to orbit relative to the other, and the size of the compression chambers changes to compress the entrapped refrigerant.

As the compression chamber nears the end of its cycle, the entrapped gas is exposed to a discharge port. The entrapped gas leaves the discharge port and moves through a check valve to a discharge plenum. The discharge check valve is typically opened during operation of the scroll compressor. The check valve closes the discharge port and desirably prevents backflow once the compressor is stopped.

In scroll compressors, there is a phenomenon known as reverse rotation. This occurs when compressed gas moves back through the discharge port and into the compression chamber to drive the scroll compressor wraps relative to each other in a reverse direction at shutdown of the compressor. This is undesirable, and results in unwanted noise and potential harm to the compressor components.

One method of minimizing the amount of reverse rotation is to minimize the volume of compressed gas which will move between the scroll wraps at shutdown. The present invention provides a discharge valve that is designed to be fast acting in closing the discharge port upon shutdown of the compressor.

A discharge valve, according to the principles of the present invention, includes a valve seat having a seat surface facing downstream of a discharge passage of the scroll compressor. A valve member is provided having a body portion for engaging the seat surface of the valve seat for closing the discharge passage. The valve member includes a guide portion extending axially from the body portion. A retainer is slidably engaged with the guide portion of the valve member and includes at least one passage communicating with a space between the valve member and the retainer. According to one aspect of the present invention, the guide portion of the valve member includes at least one notch portion in communication with the space between the valve member and the retainer. During operation of the scroll compressor, the valve member is lifted away from the valve seat and slidably moves relative to the retainer to an open position. At shutdown, the discharge pressure in the discharge chamber acts upon the valve member through the at least one passage communicating with the space between the valve member and the retainer to cause the valve member to move to its closed position. The notched portions in the guide portion of the valve member serve a dampening effect with regard to the motion of the valve member between the open and closed positions.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 2 is a detailed cross-sectional view of the discharge valve shown in FIG. 1;

FIG. 4 is a cross-sectional view of a discharge valve according to an alternative embodiment of the present invention;

FIG. 5A is a cross-sectional view of a discharge valve according to an alternative embodiment of the present invention;

FIG. 5B is a top view of the valve retainer shown in FIG. 5A;

FIG. 6A is a cross-sectional view of a discharge valve according to yet another embodiment of the present invention;

FIG. 6B is a top view of the retainer shown in FIG. 6A;

FIG. 7A is a cross-sectional view of still another embodiment of the discharge valve according to the principles of the present invention;

FIG. 7B is a plan view of the slots formed in the muffler plate shown FIG. 7A;

FIG. 8A is a cross-sectional view of still another embodiment of the discharge valve according to the principles of the present invention;

FIG. 8B is a plan view of the slots formed in the muffler plate according to the principles of the present invention;

FIG. 9 is a cross-sectional view of a discharge valve according to an alternative embodiment of the present invention;

FIG. 10 is a perspective view of the valve member shown in FIG. 9;

FIG. 11 is a cross-sectional view of a discharge valve according to an alternative embodiment of the present invention;

FIG. 12 is a perspective view of the valve member shown in FIG. 11;

FIG. 13 is a cross-sectional view of a discharge valve according to an alternative embodiment of the present invention;

FIG. 14 is a cross sectional view taken along line 14-14 of FIG. 13;

FIG. 15A is a cross-sectional view of a discharge valve according to an alternative embodiment of the present invention with the valve member being shown in a fully open position;

FIG. 15B is a cross-sectional view of the discharge valve shown in FIG. 15A, with the valve member being shown in a partially closed position; and FIG. 15C is a cross-sectional view of the discharge valve shown in FIG. 15A, with the valve member being shown in a fully seated position.

DETAILED DESCRIPTION OF THE PREFERRED EMBODIMENTS

The following description of the preferred embodiments is merely exemplary in nature and is in no way intended to limit the invention, its application, or uses.

Figure 1:
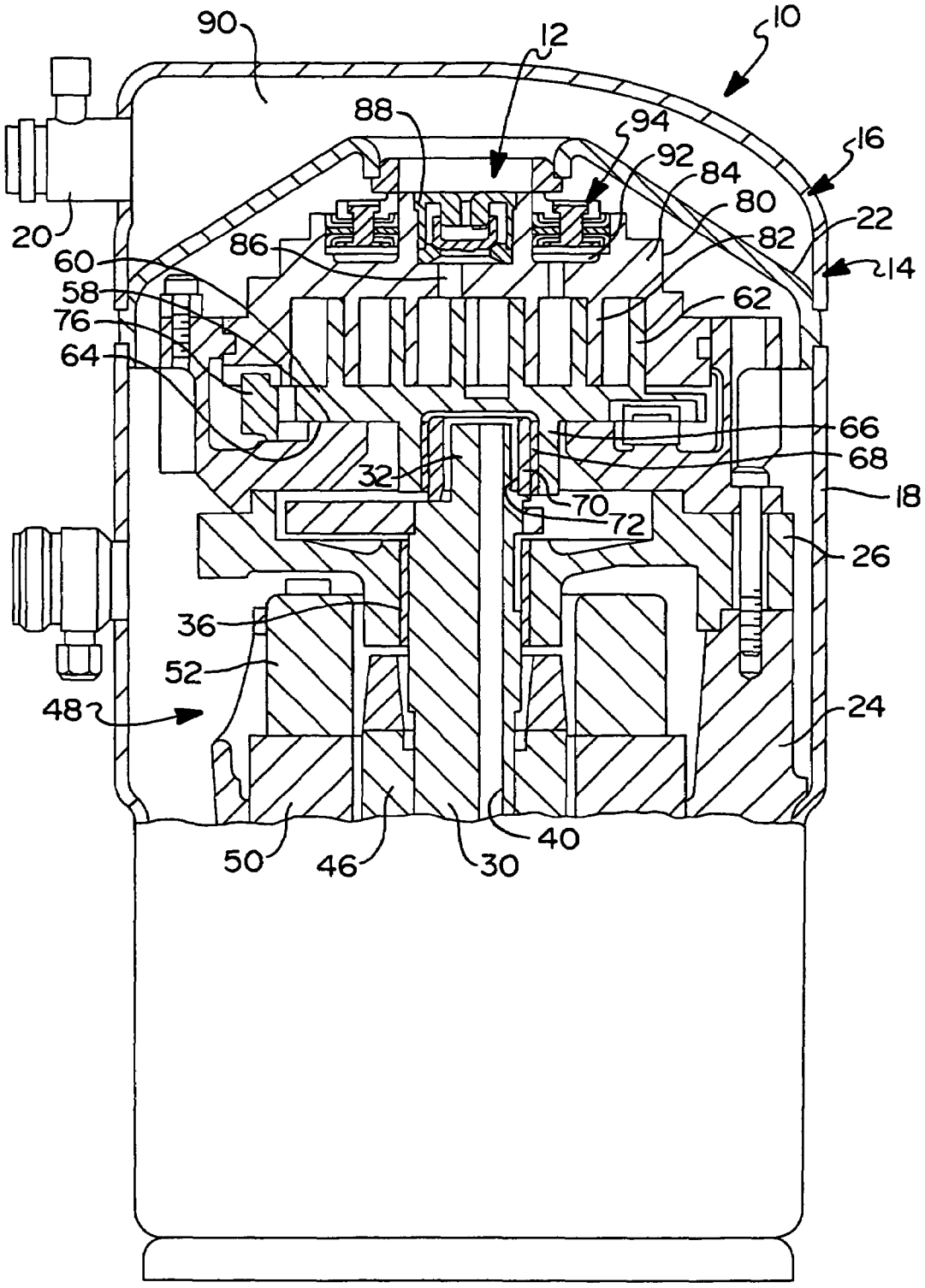
FIG. 1 is a cross-sectional view of a scroll compressor incorporated with a discharge valve, according to the principles of the present invention.

At the outset, it is noted that the herein described compressor embodiments are the subject of commonly assigned U.S. Pat. No. 6,139,291 to Perezovchikov, the disclosure of which is incorporated herein by reference. Referring now to the drawings in which like reference numerals designate like or corresponding parts throughout the several views, there is shown in FIG. 1 a scroll compressor 10 that incorporates a discharge valve assembly 12 in accordance with the present invention. Compressor 10 comprises a generally cylindrical hermetic shell 14 having welded at the upper end thereof a cap 16 and at the lower end thereof a base 18. Cap 16 is provided with a refrigerant discharge fitting 20. Other major elements affixed to shell 14 include a transversely extending partition or muffler plate 22 which is welded to the shell 14 about its periphery. A main bearing housing 24 is suitably secured to shell 14 and a two piece upper bearing housing 26 is suitably secured to main bearing housing 24.

A drive shaft or crank shaft 30 having an eccentric crank pin 32 at the upper end thereof is rotatably journaled in a first bearing (not shown) in main bearing housing 24 and a second bearing 36 in upper bearing housing 26. Crank shaft 30 has at the lower end a relatively large diameter eccentric bore which communicates with a radially outwardly inclined smaller diameter bore 40 extending upwardly therefrom to the top of crankshaft 30. The lower portion of the shell interior defines an oil sump which is filled with lubricating oil to a level slightly above the lower end of a rotor 46, and the eccentric bore acts as a pump to pump lubricating oil up crankshaft 30 and into bore 40 and ultimately to all the various portions of compressor 10 that require lubrication.

Crankshaft 30 is rotatably driven by an electric motor 48 including a stator 50, windings 52 passing therethrough, and rotor 46 being press fit on crankshaft 30 and having an upper counterweight and a lower counterweight (not shown). An upper surface 58 of upper bearing housing 26 is provided with a flat thrust bearing surface on which is disposed an orbiting scroll member 60 having a spiral vein or wrap 62 extending upward from an end plate 64. Projecting downwardly from a lower surface of end plate 64 of orbiting scroll member 60 is a cylindrical hub 66 having a journal bearing 68 therein, and in which is rotatably disposed a drive bushing 70 having an inner bore 72 in which crank pin 32 is drivingly disposed. Crank pin 32 has a flat on one surface that engages a flat surface (not shown) formed in a portion of bore 72 to provide a radially compliant driving arrangement, such as shown in Assignee's U.S. Pat. No. 4,877,382, the disclosure of which is hereby incorporated herein by reference.

An Oldham coupling 76 is also provided and positioned between orbiting scroll member 60 and upper bearing housing 26 and is keyed to orbiting scroll member 60 and a non-orbiting scroll member 80 to prevent rotational movement of orbiting scroll member 60. Oldham coupling 76 is preferably of the type disclosed in Assignee's U.S. Pat. No. 5,320,506, the disclosure of which is hereby incorporated herein by reference.

Non-orbiting scroll member 80 is provided with a wrap 82 which extends downwardly from an end plate 84 and is positioned in meshing engagement with wrap 62 of orbiting scroll member 60. Non-orbiting scroll member 80 has a centrally disposed discharge passage 86 that communicates with an upwardly open recess 88 that in turn is in fluid communication with a discharge muffler chamber 90 defined by cap 16 and the partition 22. An annular recess 92 is formed in non-orbiting scroll member 80, within which is disposed a floating seal assembly 94. Recesses 88, 92, and floating seal assembly 94 cooperate to define an axial pressure biasing chamber which receives pressurized fluid being compressed by wraps 62, 82 so as to exert an axial biasing force on the non-orbiting scroll member 80 to thereby urge tips of the respective wraps 62, 82, into sealing engagement with opposed end plate surfaces of end plates 64, 84, respectively. Floating seal assembly 94 is preferably of the type described in greater detail in U.S. Pat. No. 5,156,539, the disclosure of which is incorporated herein by reference. Non-orbiting scroll member 80 is designed to be mounted to main bearing housing 24 in a suitable manner such as disposed in the aforementioned U.S. Pat. Nos. 4,877,382 or 5,102,316, the disclosures of which are incorporated herein by reference.

The present invention is directed towards normally closed mechanical discharge valve assembly 12 that is disposed within recess 88 that is formed in non-orbiting scroll member 80. Discharge valve assembly 12 moves between a fully closed and a fully opened condition during steady state operation of compressor 10. Valve assembly 12 will close during the shutdown of compressor 10. When valve assembly 12 is fully closed, the recompression volume is minimized and reverse flow of discharge gas through scroll members 60, 80 is prohibited. Valve assembly 12 is normally closed as shown in FIG. 2. The normally closed configuration for valve assembly 12 requires a discharge force (i.e., pressure differential) to open valve assembly 12. Valve assembly 12 relies on the pressure within the discharge muffler chamber 90 to cause the valve 12 to close.

Figure 3:
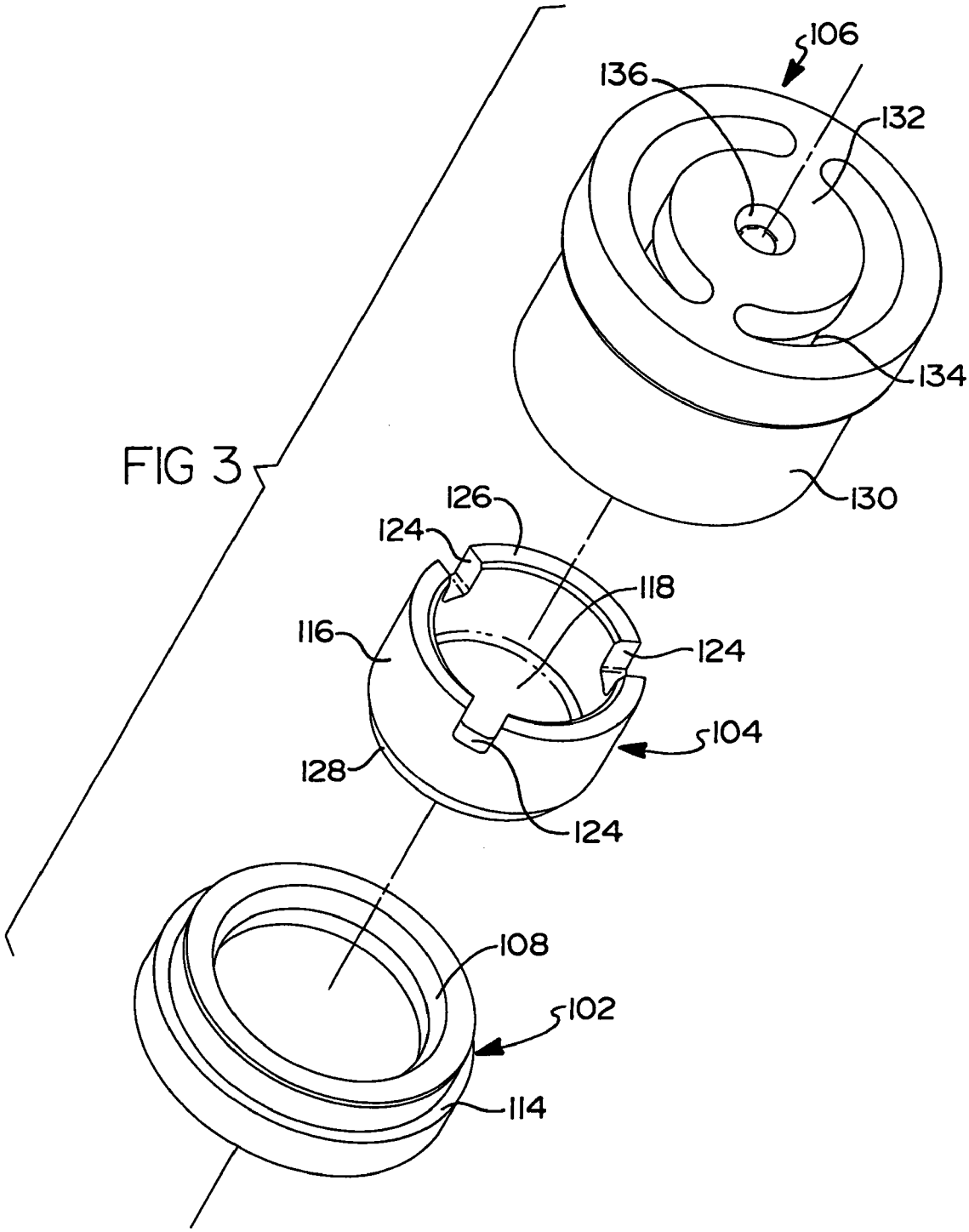
FIG. 3 is an exploded perspective view of the components of the discharge valve shown in FIG. 2.

Referring now to FIGS. 2 and 3, discharge valve assembly 12 includes a valve plate 102 defining a valve seat disposed in the upwardly open recess 88 in the non-orbiting scroll member 80 adjacent to discharge passage 86. A valve member 104 is provided for enclosing the passage through the valve plate 102. A retainer 106 is provided for retaining and guiding movement of the valve member 104.

The valve plate 102 defines a valve seat including a seat surface 108 having a frusto conical shape and facing in a downstream direction from the discharge port 86. The valve plate 102 includes the central aperture 110 adjacent to the seat surface 108. The seat surface 108 is disposed at approximately 50-60 degrees from the axis of the valve plate. An upstream surface 112 of the valve plate 102 is also angularly disposed relative to the axis of the valve plate 102 at approximately 50-60 degrees. The outer perimeter of the valve plate 102 includes a recessed portion 114.

The valve member 104 is generally cup-shaped and includes a generally cylindrical sidewall portion 116 and a base portion 118 enclosing a forward end of the cylindrical sidewall 116. The base portion 118 includes a central nub 120 extending axially therefrom. The outer perimeter of the base portion 118 includes a frusto conical surface 122 between the inner face of the base portion 118 and cylindrical sidewall 116. The frusto conical portion 122 is disposed at approximately 50-60 degrees from the central axis of the valve member. The cylindrical sidewall 116 includes a plurality of equally spaced notches 124 (best seen in FIG. 3) extending axially from a rearward end 126 of the cylindrical sidewall 116 toward a forward end 128 of the cylindrical sidewall. In the embodiment shown in FIG. 3, three notches 124 are provided. As an alternative, slots 124' can be provided in the sidewall 116 as illustrated in FIGS. 9 and 10. As a further alternative, as shown in FIGS. 11 and 12, holes 124" can be provided in the sidewall 116. The holes 124" can be molded in or drilled. The slots 124' and holes 124" provide a rigid sidewall 116 while still providing vent passages therethrough. As a still further alternative, as shown in FIGS. 13 and 14, the stem 134 of the retainer 106 can be provided with recesses 140 while the sidewalls 116 of the valve member 104 is not provided with any venting formations.

The retainer 106 includes a cylindrical outer sidewall 130 and a retainer base portion 132 disposed on a rearward end of the cylindrical outer sidewall 130. A central stem 134 extends axially from the retainer base portion 132 and includes a through hole 136 extending axially therethrough. The valve member 104 is slidably received on the central stem 134 of the retainer 106. Through operation of the scroll compressor 10, the valve member 104 is opened by gas flow from the scroll compressor. The valve member 104 is freely sliding over the stem 134 of the retainer 106. The venting formations 124, 124', 124", 140 provide venting of the space 138 between the valve member 104 and stem 134 which defines a damper cavity on movement of the valve member 104. When the valve member 104 is opening, the gas in the valve cavity 138 is being compressed and leaks away through the restriction hole 136 and stem 134 radial clearance. This causes the pressure in the valve cavity to increase, therefore reducing the valve velocity and impact on the retainer 106. After gas communication through the venting formations 124, 124', 124", 140 have been shut off, gas flow to or from the damper cavity is restricted by the valve 104 and stem 134 radial clearance. During a fraction of a revolution, when there is a negative pressure drop across the valve which causes the valve member to go down, pressure in the valve cavity is being reduced due to its increasing volume and pressure drop across the hole 136 and stem 134 radial clearance, reducing the valve velocity and introducing a delay in valve closing.

With reference to FIG. 4, an alternate embodiment of the discharge valve 4-10 is shown. The discharge valve 4-10 includes a valve seat 4-12 including a cylindrical sidewall portion 4-14 received in the upwardly extending recess 4-16 of the fixed scroll member 4-18. A valve member 4-20 is provided adjacent to the valve seat 4-12 and a discharge passage 4-22. The valve member 4-20 includes a disk-shaped body portion 4-20*a* with a rearwardly extending cylindrical wall portion 4-20*b*. A plurality of notches 4-20*c* are provided in the cylindrical wall portion 4-20*b*. A valve retainer 4-24 includes a cup-shaped body portion 4-24*a* having a shoulder portion 4-24*b* against which the valve member 4-20 abuts. A spring 4-26 is provided in the cup-shaped body portion 4-24a and biases the valve member 4-20 against the valve seat 4-12. A passage 4-28 is provided generally centrally located in the base of the cup-shaped portion 4-24*a*. The retainer 4-24 includes a radially extending flange portion 4-24*c*. The flange portion 4-24*c* includes passages 4-30 spaced circumferentially around the flange 4-24*c* to allow the discharge of compressed gas to pass therethrough. The retainer 4-24 is retained in place by a clip 4-32 which is received in a groove 4-34 in the sidewall of the recess 4-16. During operation, when the valve member 4-20 starts to open, gases in the volume 4-36 flow through the notches 4-20*c* and hole 4-28 in order to provide for rapid opening of the valve. When the notches 4-20*c* are closed off by the cup-shaped body portion 4-24*a* of the valve retainer 4-24, the flow only passes through the hole 4-28 and the radial clearance between the valve member 4-20 and retainer 4-24. The reduced flow provides more dampening which reduces the impact between the valve member 4-20 and the shoulder 4-24*b* of valve retainer 4-24.

When the valve member 4-20 starts to close, the valve member 4-20 begins to move rapidly under pressure in the volume 4-36 and the spring 4-26. When the notches 4-20*c* open to allow a flow passage, the pressure in the volume 4-36 drops rapidly and reduces the force pressing down on the valve member 4-20 so that the impact of the valve member 4-20 and valve seat 4-12 is reduced.

With reference to FIGS. 5A-5B, another embodiment of the discharge valve 5-10 will now be described. The discharge valve 5-10 includes a valve seat surface 5-12 disposed adjacent to discharge opening 5-14. A valve member 5-16 is provided in the upwardly open recess portion 5-18 of the fixed scroll member 5-20. A valve retainer 5-22 is supported by a partition plate 5-24. The retainer includes a cylindrical wall portion 5-22*a* having radially extending apertures 5-26 extending therethrough. A radial flange 5-22*b* extends radially outward from the cylindrical sidewall 5-22*a* which is disposed against the partition plate 5-24. A radially inwardly extending flange portion 5-22*c* extends from the upstream end of the cylindrical sidewall portion 5-22*a* and defines an opening 5-30 for receiving a central lug portion 5-32 of the valve member 5-16. The valve member 5-16 includes a cylindrical outer wall portion 5-34 which has an inner surface which receives the outer surface of the retainer member 5-22. The valve member 5-16 is exposed to a back pressure through the retainer 5-22 that causes the valve member 5-16 to close when the compressor is shut down. The space 5-40 between the valve member 5-16 and the inwardly extending flange portion 5-22*c* dampens the movement of the valve member 5-16 during pressure fluctuations.

With reference to FIGS. 6A-6B the valve assembly 6-10 is substantially the same as the valve assembly 5-10 with the exception that the valve member 6-16 includes a sliding fit with the hole 5-30 in the valve retainer 5-22, and the valve member 6-16 does not include an outer cylindrical surface such as cylindrical surface 5-S4 of the valve member 5-16. With this arrangement, the sliding engagement of the valve member 6-16 and retainer 5-22 dampens movement of the valve member 6-16.

With reference to FIGS. 7A-7B, another embodiment of the discharge valve 7-10 will now be described. The discharge valve 7-10 includes a valve seat surface 7-12 disposed adjacent to discharge opening 7-14 provided in the fixed scroll 7-16. A valve member 7-18 is provided in the upwardly open recess portion 7-20 of the fixed scroll member 7-16. A valve retainer 7-22 is supported by the muffler plate 7-24. The retainer 7-22 includes an elongated base portion 7-26 attached at one end to the muffler plate 7-24 and having at a second end thereof a radially extending flange portion 7-28. The radially extending flange portion 7-28 includes apertures 7-30 extending therethrough. The valve member 7-18 includes a generally flat base portion 7-32 with a cylindrical sidewall 7-34 extending rearwardly therefrom. The cylindrical sidewall 7-34 is provided with recessed notches 7-36 spaced about the cylindrical sidewall.

The radially extending flange portion 7-28 is received within the cylindrical extending sidewall 7-34 of the valve member so that the valve member is capable of moving axially relative to the retainer 7-22. The valve member 7-18 is optionally provided with radially inwardly extending fingers 7-38 which retain the valve member 7-18 to the retainer 7-22 during installation of the valve assembly 7-10. The retainer 7-22 has an end portion 7-40 which is received in an aperture 7-42 in the muffler plate 7-24 and is crimped radially outwardly in order to retain the retainer 7-22 to the muffler plate 7-24. The muffler plate further includes apertures 7-44, as best illustrated in FIG. 7B, for allowing discharge of compressed gas through the muffler plate 7-24. A seal ring 746 is disposed between the fixed scroll 7-16 and the muffler plate

7-24. During operation, the space 7-50 between the valve member 7.15 and the retainer 7-22 dampens movement of the valve member 7-18.

With reference to FIGS. 8A-8B, the valve assembly 8-10, as shown is substantially the same as the valve assembly 7-10 as discussed above, with the exception that the valve member 8-18 further includes a centrally disposed axially extending lug 8-20 which is received in a recess 8-22 provided in the end of the retainer 8-24. The lug 8-20 includes radially extending fingers 8-26 which are engaged by shoulder portion 8-28 in the opening 8-22 of the retainer 8-24.

With reference to FIGS. 15A-15C, wherein common reference numerals are used to represent common elements as disclosed in FIGS. 2 and 3, the valve member 15-10 includes a generally cylindrical section 15-12 at the bottom of the valve member 15-10 which engages with the cylindrical surface 110 of the valve seat 15-14 with a controlled clearance therebetween when the valve member 15-10 is approaching the valve seat 15-14. The valve seat 15-14 includes a cylindrical surface 15-16 on top of the conically shaped valve seat surface 15-18, which engages with the outer cylindrical surface 15-20 of the valve member 15-10 when the valve member 15-10 is approaching the seat 15-14. As a result, when the cylindrical surfaces 15-12, 110; 15-16, 15-20 engage, a seat damper cavity 15-22, as shown in FIG. 15B, is formed. When the valve member 15-10 is approaching the vale seat 15-14 and the cavity 15-22 is formed, gas pressure in the cavity 15-22 is increasing due to its volume reduction and flow restriction for the gas to escape through the clearances between respective cylindrical surfaces 15-12, 110; 15-16, 15-20. Elevation of gas pressure in the seat damper cavity 15-22 reduces the valve member velocity during valve closing, reducing the impact velocity of the valve 15-10 and seat 15-14 engagement, therefore reducing impact induced stresses, improving reliability of the valve and compressor sound characteristics.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A discharge valve for a scroll compressor, comprising:

a valve seat surface facing downstream of a discharge passage of the scroll compressor;

a valve member displaceable between open and closed positions and having a body portion for engaging said seat surface for closing said discharge passage, said valve member including a cylindrical guide portion extending axially from said body portion; and a retainer including an axially extending stem portion slidably engaging with said cylindrical guide portion of said valve member and defining a fluid chamber therebetween, said cylindrical guide portion receiving said retainer, said stem portion of said retainer including at least one through hole extending axially through said retainer and in communication with said fluid chamber, said passage limiting a flow of a fluid in said fluid chamber through said passage to damp an opening velocity of said valve member as said valve member is displaced to said open position.

2. The discharge valve according to claim 1, wherein said guide portion of said valve member includes at least one vent formation in communication with said fluid chamber.

3. The discharge valve according to claim 2, wherein said at least one vent formation includes a notch in said valve member.

4. The discharge valve according to claim 2, wherein said at least one vent formation includes a slot in an interior of said cylindrical sidewall.

5. The discharge valve according to claim 2, wherein said at least one vent formation includes a hole in said valve member.

6. The discharge valve according to claim 1, wherein said stem portion of said retainer includes at least one axially extending recess in a surface thereof.

7. A discharge valve for a scroll compressor, comprising:

a valve seat surface facing downstream of a discharge passage of the scroll compressor;

a valve member displaceable between open and closed positions and having a body portion for engaging said seat surface for closing said discharge passage, said valve member including a guide portion extending axially from said body portion; and a retainer slidably engaging with said guide portion of said valve member and defining a fluid chamber therebetween, said guide portion receiving said retainer, said retainer including at least one passage in communication with said fluid chamber, said passage limiting a flow of a fluid in said fluid chamber through said passage to damp an opening velocity of said valve member as said valve member is displaced to said open position;

wherein said retainer includes a cylindrical sidewall portion having a plurality of radially extending apertures therethrough.

8. The discharge valve according to claim 7, wherein said valve member includes a central lug portion received in said cylindrical sidewall portion of said retainer.

9. The discharge valve according to claim 8, wherein said valve member includes a cylindrical outer wall portion which receives said retainer therein.

10. A discharge valve for a scroll compressor, comprising:

a valve seat surface facing downstream of a discharge passage of the scroll compressor;

a valve member displaceable between open and closed positions and having a body portion for engaging said seat surface for closing said discharge passage, said valve member including a guide portion extending axially from said body portion; and a retainer slidably engaging with said guide portion of said valve member and defining a fluid chamber therebetween, said guide portion receiving said retainer, said retainer including at least one passage in communication with said fluid chamber, said passage limiting a flow of a fluid in said fluid chamber through said passage to damp an opening velocity of said valve member as said valve member is displaced to said open position;

wherein said retainer includes an elongated base portion and a radially extending flange portion that is received in a cylindrical sidewall portion of said valve member, said radially extending flange portion including at least one passage therethrough in communication with said fluid chamber.

11. The discharge valve according to claim 10, wherein said elongated base portion of said retainer is mounted to a partition plate, said partition plate including at least one discharge passage extending therethrough.

12. A discharge valve for a scroll compressor, comprising:

a valve seat surface facing downstream of a discharge passage of the scroll compressor;

a valve member displaceable between open and closed positions and having a body portion for engaging said seat surface for closing said discharge passage, said valve member including a guide portion extending axially from said body portion; and a retainer slidably engaging with said guide portion of said valve member and defining a fluid chamber therebetween, said guide portion receiving said retainer, said retainer including at least one passage in communication with said fluid chamber, said passage limiting a flow of a fluid in said fluid chamber through said passage to damp an opening velocity of said valve member as said valve member is displaced to said open position;

wherein said retainer has a cup shaped body portion for receiving a lug portion of said valve member therein.

13. A discharge valve for a scroll compressor, comprising:

a valve seat surface disposed in a discharge passage of the scroll compressor, said valve seat surface facing downstream from the discharge passage;

a valve member displaceable between open and closed positions and having a generally cup-shaped body with a cylindrical sidewall and a base portion enclosing a forward end of said cylindrical sidewall, said cylindrical sidewall including at least one vent formation in said cylindrical sidewall; and a retainer having a cylindrical outer sidewall and a retainer base portion disposed in a rearward end of said cylindrical outer sidewall, a central stem axially extending from said retainer base portion, said cylindrical sidewall of said valve member being slidably received on said central stem and defining a fluid chamber therebetween, said central stem including a through hole extending axially therethrough, said through hole limiting a flow of a fluid in said fluid chamber through said through hole to damp an opening velocity of said valve member as said valve member is displaced to said open position.

14. The discharge valve according to claim 13, wherein said at least one vent formation includes a notch in said cylindrical sidewall.

15. The discharge valve according to claim 13, wherein said at least one vent formation includes a slot in said cylindrical sidewall.

16. The discharge valve according to claim 13, wherein said at least one vent formation includes a hole in said cylindrical sidewall.

17. A compressor, comprising:

a shell;

a compression mechanism including first and second scroll members meshingly engaged with one another, said first scroll member including a recess in an end plate thereof and a discharge passage in communication with said recess; and a valve assembly disposed in said recess and including a valve seat surface facing downstream of the discharge passage, a cup-shaped valve member displaceable between open and closed positions, and a retainer, said cup-shaped valve member including a body portion and a cylindrical guide portion extending axially from said body portion, said body portion engaged with said seat surface and closing said discharge passage when in said closed position, said cylindrical guide portion of said valve member slidably engaged with an axially extending stem portion of said retainer and defining a fluid chamber therebetween, said cylindrical guide portion of said cup-shaped valve member receiving said stem portion of said retainer, said stem portion of said retainer including at least one through hole extending axially through said retainer and in communication with said fluid chamber, said passage limiting a flow of a fluid in said fluid chamber.

18. The compressor according to claim 17, wherein said cylindrical guide portion of said valve member includes at least one vent formation in communication with said fluid chamber.

19. The compressor according to claim 18, wherein said at least one vent formation includes a notch in said valve member.

20. The compressor according to claim 18, wherein said at least one vent formation includes a hole in said valve member.

21. The compressor according to claim 17, wherein said at least one vent formation includes a slot in an interior of said cylindrical sidewall.

22. A compressor, comprising:

a shell;

a compression mechanism including first and second scroll members meshingly engaged with one another, said first scroll member including a recess in an end plate thereof and a discharge passage in communication with said recess; and a valve assembly disposed in said recess and including a valve seat surface facing downstream of the discharge passage, a valve member displaceable between open and closed positions, and a retainer, said valve member including a body portion and a guide portion extending axially from said body portion, said body portion engaged with said seat surface and closing said discharge passage when in said closed position, said guide portion of said valve member slidably engaged with said retainer;

wherein said retainer includes a cylindrical sidewall portion having a plurality of radially extending apertures therethrough said valve member includes a central lug portion received in said cylindrical sidewall portion of said retainer.

23. The compressor according to claim 22, wherein said valve member includes a cylindrical outer wall portion which receives said retainer therein.

24. A compressor, comprising:

a shell;

a compression mechanism including first and second scroll members meshingly engaged with one another, said first scroll member including a recess in an end plate thereof and a discharge passage in communication with said recess; and a valve assembly disposed in said recess and including a valve seat surface facing downstream of a discharge passage, a valve member displaceable between open and closed positions, and a retainer, said valve member including a body portion and a guide portion extending axially from said body portion, said body portion engaged with said seat surface and closing said discharge passage when in said closed position, said guide portion of said valve member slidably engaged with said retainer and defining a fluid chamber therebetween, said guide portion receiving said retainer, said retainer including at least one passage in communication with said fluid chamber, said passage limiting a flow of a fluid in said fluid chamber through said passage to damp an opening velocity of said valve member as said valve member is displaced to said open position;

wherein said retainer includes an elongated base portion and a radially extending flange portion that is received in a cylindrical sidewall portion of said valve member, said radially extending flange portion including at least one passage therethrough in communication with said fluid chamber.

25. The compressor according to claim 24, wherein said elongated base portion of said retainer is mounted to a partition plate, said partition plate including at least one discharge passage extending therethrough.

26. A compressor, comprising:

a shell;

a compression mechanism including first and second scroll members meshingly engaged with one another, said first scroll member including a recess in an end plate thereof and a discharge passage in communication with said recess; and a valve assembly disposed in said recess and including a valve seat surface facing downstream of a discharge passage, a valve member displaceable between open and closed positions, and a retainer, said valve member including a body portion and a guide portion extending axially from said body portion, said body portion engaged with said seat surface and closing said discharge passage when in said closed position, said guide portion of said valve member slidably engaged with said retainer and defining a fluid chamber therebetween, said guide portion receiving said retainer, said retainer including at least one passage in communication with said fluid chamber, said passage limiting a flow of a fluid in said fluid chamber through said passage to damp an opening velocity of said valve member as said valve member is displaced to said open position;

wherein said retainer has a cup shaped body portion for receiving a lug portion of said valve member therein.

27. A discharge valve for a scroll compressor, comprising:

a valve seat surface disposed in a discharge passage of the scroll compressor, said valve seat surface facing downstream from the discharge passage;

a valve member displaceable between open and closed positions and having a generally cup-shaped body with a cylindrical sidewall and a base portion enclosing a forward end of said cylindrical sidewall; and a retainer having a retainer base portion, and a central stem axially extending from said retainer base portion, said cylindrical sidewall of said valve member being slidably received on said central stem and defining a fluid chamber therebetween, said central stem including a through hole extending axially therethrough, said through hole limiting a flow of a fluid in said fluid chamber through said through hole to damp an opening velocity of said valve member as said valve member is displaced to said open position.

* * * * *